United States Patent [19]

Thomas

[11] 4,261,494

[45] Apr. 14, 1981

[54] UMBRELLA HOLDER

[76] Inventor: Clarence Thomas, 429 W. 45th St., New York, N.Y.

[21] Appl. No.: 94,651

[22] Filed: Nov. 15, 1979

[51] Int. Cl.[3] ..... A41D 27/20

[52] U.S. Cl. ..... 224/205; 224/250; 224/214; 224/915

[58] Field of Search ..... 224/205, 150, 202, 214, 224/228, 237, 241, 250, 252, 269, 915, 916

[56] References Cited

U.S. PATENT DOCUMENTS

| | | | |
|---|---|---|---|
| 702,398 | 6/1902 | Bowyer | 224/250 |
| 792,126 | 6/1905 | Freund | 224/250 |
| 811,437 | 1/1906 | Read | 224/250 X |
| 1,270,207 | 6/1918 | Preston | 224/250 X |
| 1,521,531 | 12/1924 | Harold | 224/250 X |
| 2,715,989 | 8/1955 | Sjodin et al. | 224/214 |
| 3,279,663 | 10/1966 | Torres | 224/915 X |

*Primary Examiner*—Steven M. Pollard

*Attorney, Agent, or Firm*—Burgess, Ryan and Wayne

[57] ABSTRACT

A holder for a closed umbrella having an umbrella embracing member and a shoulder encircling strap. The umbrella embracing member is a flat member which encircles the umbrella and is suspended from the strap in such a way that the umbrella is held substantially vertically and in the vicinity of the wearer's shoulder blade.

4 Claims, 6 Drawing Figures

UMBRELLA HOLDER

BACKGROUND OF THE INVENTION

This invention relates to an umbrella holder, and more specifically this invention relates to a holder for carrying a closed umbrella and worn on the shoulder of the user.

Among the many inventions made throughout the history of mankind, probably one of the most useful is the umbrella. The umbrella is a device which can be carried in a relatively compact form and opened to shield the user from rain or hot sun only when needed. Yet, with all its virtues when in use, the umbrella possesses one glaring fault. This fault resides in the fact that when it is not in use, and is being carried by the user, it must be carried by hand and is apt to be lost or stolen. Furthermore, when the user is carrying other items, the umbrella becomes awkward to manipulate.

Various attempts have been made to devise a holder to carry an umbrella on the user's person and to free his hands. For instance, Hilburger Pat. No. 1,827,524 discloses a holder which may be used to carry a closed umbrella and which relies on alligator clips to attach two separate members, an upper member and a lower member, to the front of the user's shirt or jacket. The umbrella is clamped in place on the brackets. The disadvantages associated with this system are several-fold. First, the system comprises two separate members which can easily be separated and lost. Second, the closed umbrella, if it is wet, will drip and wet the user's clothing. Third, the upper and lower members have a number of moving parts which will eventually wear out and break.

In Conrad Pat. No. 2,926,826, there is disclosed a complicated arrangement which basically comprises a harness fitting over both shoulders and having cross-members in front and in back. Straps are provided in back to tie an umbrella cross-wise to the depending leg members. This device is cumbersome and does nothing to protect the wearer's clothing from a wet umbrella.

BRIEF SUMMARY OF THE INVENTION

It is, therefore, a primary object of the present invention to provide a holder for a closed umbrella which is free of the aforementioned and other such disadvantages.

It is another object of the present invention to provide a holder for a closed umbrella which is compact and light in weight.

It is yet another object of the present invention to provide a holder for a closed umbrella which is simple and inexpensive to manufacture.

Consistent with the foregoing objects, the present invention provides a holder for carrying a closed umbrella comprising umbrella embracing means and shoulder encircling means affixed thereto, and adapted to be worn by the user on the wearer's back. In the preferred embodiment, the umbrella embracing means comprises a flat elongated flexible member adapted to encircle the umbrella with the corners on one side of the longitudinal axis thereof overlying the respective corners on the other side, cooperating means on each of the overlapping corners for removably fastening the same, and a pair butt hinge members fabricated of a flexible material and each having a rigid hinge pin, one half-member of each of hinges being affixed to a longitudinal side of the flat member and centered on the transverse axis thereof, the other half-members of the hinges being adapted to overlap when the flat member is in the umbrella encircling position and having cooperating means to removably fasten the overlapping hinge members. The shoulder encircling means comprises a strap with its ends affixed to the flat member at either end thereof. In a particularly preferred embodiment, means for supporting the umbrella and catching gripping water therefrom are provided. The supporting and water catching means comprises a flexible tubular upper umbrella encircling means adapted to be removably attached to the flat member, depending connecting means, and a lower umbrella tip receiving pocket means.

The aforementioned objects, and other objects and advantages of the present invention will become apparent by reference to the following detailed description and to the annexed drawings wherein:

DETAILED DESCRIPTION OF THE PREFERRED EMBODIMENT

Figure 5:
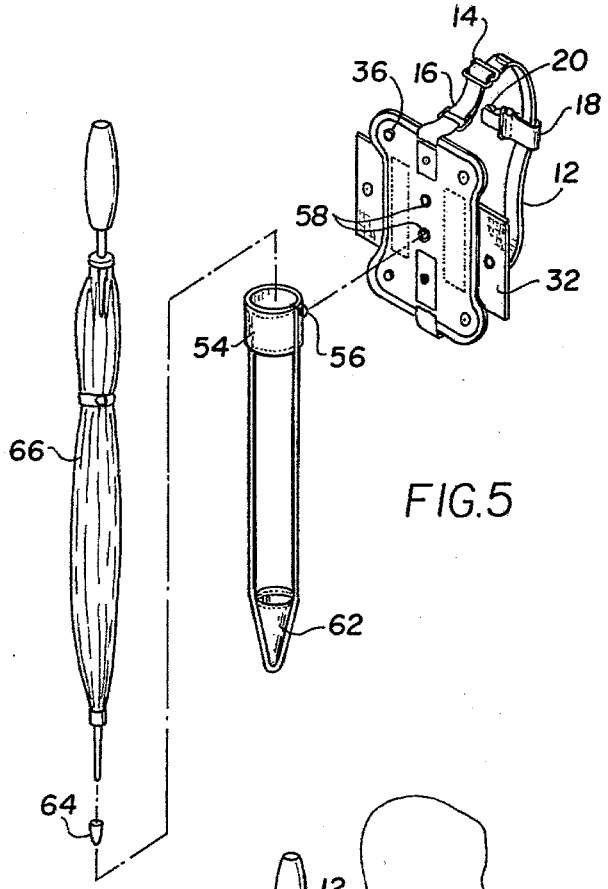
FIG. 5 is an exploded perspective view of the umbrella holder of the instant invention.
Figure 6:
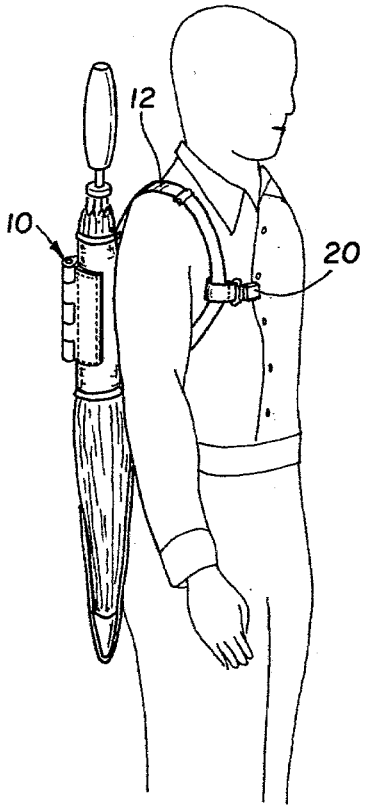
FIG. 6 is a front perspective view thereof in operative use.

The inventive umbrella holder generally comprises umbrella embracing means 10 and shoulder strap 12. Shoulder strap 12, as can be seen in FIGS. 5 and 6, is preferably an adjustable strap, the adjusting means 14 being of a type wellknown in the art such as a buckle through which the strap slides to form a loop 16 which can be shortened or lengthened to suit the user. Slidably arranged on strap 12 is a loop 18 made of a similar, preferably elastic, material carrying clip 20 for attachment to the wearer's garment such as a shirt. Clip 18 assists in stabilizing the holder when it is being worn.

Figure 1:
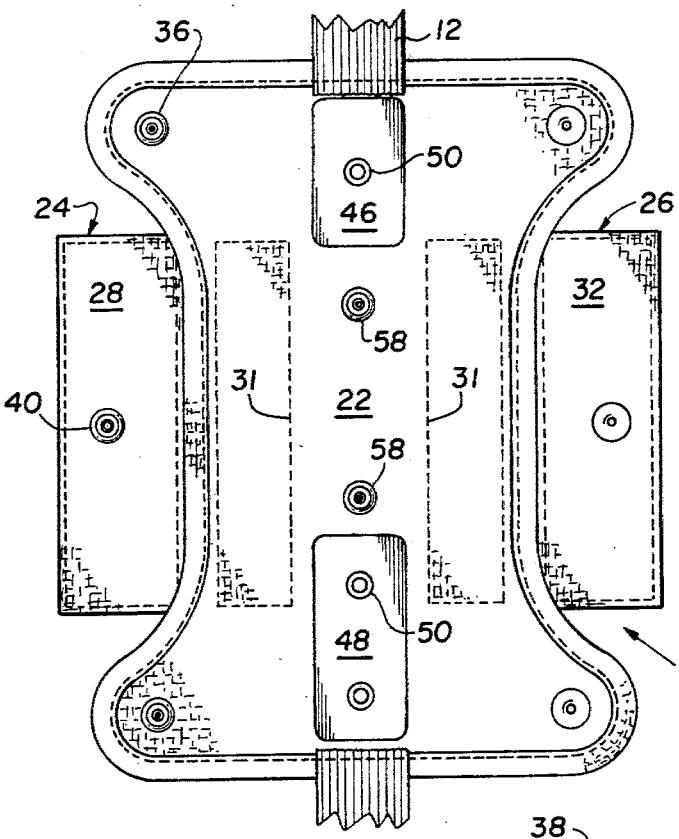
FIG. 1 is an elevational view of one side of the umbrella holder.
Figure 2:
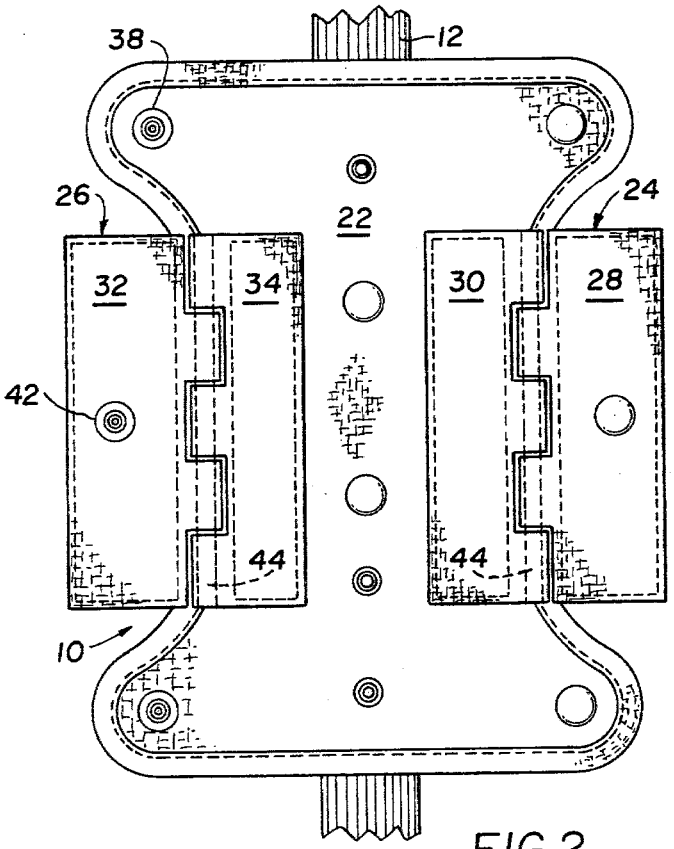
FIG. 2 is an elevational view of the other side thereof.
Figure 4:
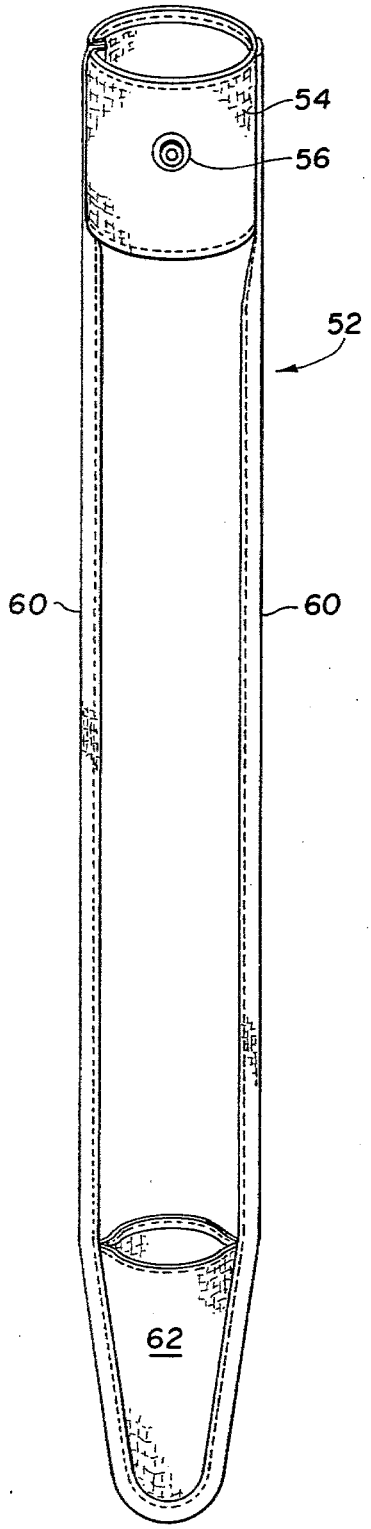
FIG. 4 is an elevational view of the supporting and water catching means.

Returning to FIGS. 1 and 2, umbrella embracing means 10 comprises an elongated flexible member 22 made of any suitable material such as a canvas-type fabric which may be suitably treated to render it water repellant, and a pair of butt hinges 24 and 26 which are also made of a suitable fabric material such as a canvas, although preferably of a heavier weight than the material used in member 22. Strap 12 is affixed to the ends of member 22 in a suitable manner such as by stitching to thus form a loop for encircling the wearer's shoulder. Butt hinges 24 and 26 each comprise cooperating mating halves 28 and 30, and 32 and 34, respectively. Inner hinge halves 30 and 34 are affixed to member 22 in any suitable manner such as by stitching. Cooperating snap fasteners 36 and 38 are provided in the four corners of member 22 and cooperating snap fasteners 40 and 42 are provided on outer halves 28 and 32 of the butt hinges. A rigid hinge pin 44, preferably made of wood, is provided in each of butt hinges 24 and 26. In order to provide additional rigidity, flat plastic plates 46 and 48 are affixed to member 22 by any suitable means such as rivets 50.

Figure 3:
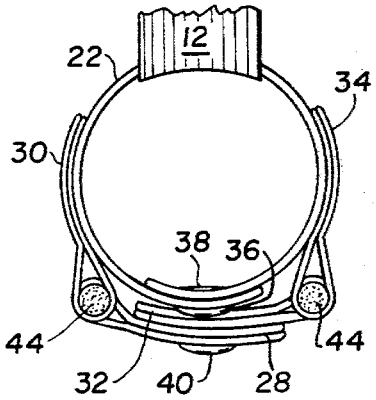
FIG. 3 is a top view of the umbrella holder in the closed position.

As can be seen from FIG. 3, when the umbrella holder is in its closed, umbrella embracing, position, the respective corners of member 22 overlap and snap fasteners 36 and 38 are closed. Similarly, outer hinge halves 28 and 32 overlap and snap fasteners 40 and 42 are closed.

When using the holder to carry a short umbrella such as the collapsible type, there is ordinarily no need for the umbrella supporting and water catching member. But, when carrying a conventional long umbrella, or a collapsible umbrella in the extending position, it is preferred that the umbrella supporting and water catching member 52 be used. Member 52 comprises an upper tubular portion 54 which encircles the umbrella and has a snap fastener half 56 affixed thereto. Snap fastener half 56 cooperates with one of snap fastener halves 58 on member 22. Portion 54 is also fabricated of a suitable material such as a canvas. Depending from portion 54 are connecting means 60 and attached to the lower end of depending connecting means 60 is water catching pocket 62 which is generally conical in shape. Pocket 62 is also fabricated of a suitable material such as a canvas and is preferably lined with a water impervious film or layer.

Referring to FIG. 5, to place the holder in use, a plastic tip 64 is preferably first placed on the metal tip of umbrella 66. Plastic tip 64 is useful in preventing wear of pocket 62. Umbrella 66 is then inserted through tubular portion 54 until the tip rests in pocket 62. Snap 56 is then attached to one of snaps 58 and member 22 is closed to completely encircle member 54 and umbrella 66. Snaps 36 and 38, and snaps 40 and 42, are then fastened. Shoulder strap 12 is adjusted to suit the wearer and slipped over the wearer's shoulder. Clip 20 is affixed to the wearer's upper garment to stabilize the holder.

Having considered the detailed description of the preferred embodiment, it will be apparent that the objects set forth at the outset has been achieved. It is to be understood that the description of the preferred embodiment is illustrative and is not to be taken as limiting, the scope of the invention being limited only by the following claims.

What is claimed is:

1. A holder for carrying a closed umbrella comprising umbrella embracing means and shoulder encircling means affixed thereto, and adapted to be worn by the user in a substantially vertical position on the wearer's back, said umbrella embracing means comprising a flat elongated flexible member adapted to encircle said umbrella with the corners on one side of the longitudinal axis thereof overlying the respective corners on the other side of said longitudinal axis, cooperating means on each of said overlapping corners for removably fastening the same, and a pair of butt hinge members fabricated of a flexible material and each having a rigid hinge pin, one half-member of each of said hinges being affixed to a longitudinal side of said flat member and centered on the transverse axis thereof, the other half-members of said hinges being adapted to overlap when said flat member is in the umbrella encircling position and having cooperating means to removably fasten said overlapping hinge members; said shoulder encircling means comprising strap means whose ends are affixed to said flat member at either end thereof, whereby said umbrella embracing means holds the umbrella in a substantially vertical position in the vicinity of the wearer's shoulder blade.

2. A holder for carrying an umbrella as claimed in claim 1, further comprising means for supporting said umbrella and catching water dripping therefrom, said last-mentioned means comprising a flexible tubular upper umbrella encircling means adapted to be removably attached to said flat member, depending connecting means, and a lower umbrella tip receiving pocket means.

3. A holder for carrying an umbrella as claimed in claim 1, wherein said strap means is adjustable.

4. A holder for carrying an umbrella as claimed in claim 1, wherein said cooperating fastening means are snap fasteners.

* * * * *